US007379794B2

(12) United States Patent
Hayashi et al.

(10) Patent No.: US 7,379,794 B2
(45) Date of Patent: May 27, 2008

(54) REMOTE CONTROL SYSTEM AND MOVING MACHINE THEREOF

(75) Inventors: Ryoji Hayashi, Tokyo (JP); Takashi Yamaguchi, Tokyo (JP)

(73) Assignee: Konami Corporation, Tokyo (JP)

( * ) Notice: Subject to any disclaimer, the term of this patent is extended or adjusted under 35 U.S.C. 154(b) by 846 days.

(21) Appl. No.: 10/491,232

(22) PCT Filed: Sep. 27, 2002

(86) PCT No.: PCT/JP02/10076

§ 371 (c)(1),
(2), (4) Date: Apr. 28, 2004

(87) PCT Pub. No.: WO03/028837

PCT Pub. Date: Apr. 10, 2003

(65) Prior Publication Data

US 2004/0249506 A1 Dec. 9, 2004

(30) Foreign Application Priority Data

Sep. 28, 2001 (JP) ..... 2001-303567

(51) Int. Cl.
*A63H 30/04* (2006.01)

(52) U.S. Cl. ..... 701/2; 701/117; 446/456

(58) Field of Classification Search ..... None
See application file for complete search history.

(56) References Cited

U.S. PATENT DOCUMENTS 4,334,221 A * 6/1982 Rosenhagen et al. ..... 463/6
4,938,483 A 7/1990 Yavetz
5,127,658 A 7/1992 Openiano
5,452,901 A * 9/1995 Nakada et al. ..... 446/454
6,661,351 B1 * 12/2003 Matsushiro ..... 340/825.69
6,848,968 B2 * 2/2005 Weiss et al. ..... 446/454
6,907,029 B2 * 6/2005 Brabrand ..... 370/347

FOREIGN PATENT DOCUMENTS

DE 24 49 660 A1 4/1976
JP 02-280787 A1 11/1990

OTHER PUBLICATIONS

Patent Abstracts of Japan for JP02-280787 published on Nov. 16, 1990.

* cited by examiner

*Primary Examiner*—Michael J. Zanelli
(74) *Attorney, Agent, or Firm*—Darby & Darby P.C.

(57) ABSTRACT

A remote control system to remote control a plurality of moving machines and to cause interaction based on communication among the moving machines without complexity and an increase in electric power consumption. A transmitting device of data containing operation control information and communication control information, and a device which specifies a transmission timing from the data from another transmitter and a transmission schedule, are provided. A controlling device controls operation on the basis of operation control information and transmission to another moving machine on the basis of communication control information at the time of receipt from the transmitter and executes a predetermined process at the time of receipt from another moving machine. The controlling device specifies a self transmission timing from the data from the transmitter and the transmission schedule, and transmits it. A transmission schedule stipulates respective transmission timings such that they do not overlap.

12 Claims, 9 Drawing Sheets

REMOTE CONTROL SYSTEM AND MOVING MACHINE THEREOF

TECHNICAL FIELD

The present invention relates to a system in which a moving machine such as an automobile, a robot, or the like is remote-controlled and in particular, to a remote control system in which a plurality of moving machines are controlled at the same place and at the same time and which is suitable for a case in which there is a need to cause interaction based on communication between the moving machines, and to a moving machine thereof.

BACKGROUND OF THE INVENTION

When a plurality of moving machines are remote-controlled at the same place by utilizing infrared radiation or radio waves and communication is carried out between the moving machines by utilizing infrared radiation or radio waves, signals transmitted from the transmitter to the moving machine and signals between the moving machines interfere with each other, and therefore, there is the fear that accurate control and communication will be difficult. As a technique solving such a problem, for example, the system disclosed in Japanese Patent No. 2713603 is well-known. In this system, a transmitter has a transmitting device which transmits, by radio waves, data for remote-controlling a corresponding moving machine. Further, the moving machine has a transmitting device which transmits, by infrared radiation, data for communicating with another moving machine, a device which receives data by radio waves, and a device which receives data by infrared radiation. In accordance therewith, a remote control operation system is realized in which signals transmitted from the transmitter and signals from the moving machine are prepared from interfering with each other, and a plurality of moving machines are remote-controlled at a same place, and communication between the moving machines is carried out.

In the above-described remote control system, a moving machine needs two different receiving devices, which are a device which receives radio waves transmitted from a transmitter and a device which receives infrared radiation transmitted from another moving machine, and a processing system. Therefore, the drawbacks that the structure of the moving machine is complicated and the electric power consumption increases arise.

SUMMARY OF THE INVENTION

Here, the object of the present invention is to provide a remote control system in which a plurality of moving machines are remote-controlled without leading to complexity of the structure of the moving machine and an increase in electric power consumption, and which can cause interaction based on communication between the moving machines.

In order to solve the above problems, according to the present invention, there is provided a remote control system in which operations of a plurality of moving machines which are readied for a plurality of transmitters, respectively, are individually controlled by the plurality of transmitters and interaction is caused between the plurality of moving machines based on communication, each of the plurality of transmitters comprising: an operation data preparing device which prepares operation data including identification information which is for identifying each of the plurality of transmitters and is unique to each of the plurality of transmitters, operation control information for controlling an operation of one of the plurality of moving machines, and communication control information for controlling the communication between the moving machines; an operation data transmitting device which transmits the operation data; an operation data receiving device which receives the operation data transmitted from another one of the plurality of transmitters; a transmission timing setting device which sets a transmission timing of self operation data on the basis of the identification information contained in the received operation data; and an operation data transmission controlling device which makes the data transmitting device transmit the operation data according to the set transmission timing, each of the plurality of moving machines comprising: a communication data preparing device which prepares communication data for making another one of the plurality of moving machines execute a predetermined processing; a communication data transmitting device which transmits the communication data; a data receiving device which receives the operation data transmitted from each of the plurality of transmitters and the communication data transmitted from said another one of the plurality of moving machines; and a moving machine controlling device which, when the operation data containing the identification information unique to one of the plurality of transmitters corresponding to oneself is received, controls self operation on the basis of the operation control information contained in the received operation data, and controls preparation and transmission of the communication data on the basis of the communication control information contained in the received operation data, and which, when the communication data from said another one of the plurality of moving machines is received, executes the predetermined processing corresponding to the received communication data, wherein for the plurality of transmitters and moving machines, a common data transmission schedule, which is stipulated such that the transmission timing of each of the operation data and the communication data does not overlap each other, is set, the transmission timing setting device of each of the plurality of transmitters refers to the identification information contained in the operation data from said another one of the plurality of transmitters, and specifies the transmission timing of self operation data stipulated by the data transmission schedule, and the moving machine controlling device refers to a receiving timing of the operation data transmitted from at least one of the plurality of transmitters, and specifies a transmission timing of self communication data stipulated by the data transmission schedule, and makes the communication data transmitting device transmit the communication data according to the specified transmission timing.

According to the remote control system of the present invention, each transmitter, by receiving data transmitted from another transmitter, and each moving machine, by referring to the receipt timing of data transmitted from each transmitter, can transmit self data according to a data transmission schedule provided such that transmission timings of each transmitter and each moving machine do not overlap. Accordingly, the data from each transmitter and the data from each moving machine can be transmitted on the same carrier signal, and sharing, at each moving machine, of a receiving device and a processing system of the signals from the transmitter and the signals from the moving machine, can be advanced. In accordance therewith, without leading to complexity of the structure of the moving machine and an increase in electric power consumption, a plurality of moving machines can be remote-controlled and interaction based on communication can be caused between the moving machines.

Further, the remote control system of the present invention can include the following modes.

The data transmission schedule may be stipulated such that the transmission timing of each of the operation data and the communication data cyclically arrives in a predetermined order.

In this way, by only stipulating the transmission schedule of one period of operation data and communication data, each transmitter and each moving machine can specify a period in which the self data can be transmitted. Further, because data transmission is carried out each period, even if one part of the transmitters cuts off data transmission in the midst thereof, another transmitter and moving machine can specify the period allocated to themselves and transmit data.

In each cycle, periods in which the plurality of transmitters are allowed to transmit the operation data, respectively, may be stipulated so as to have time lengths equal to each other, and periods in which the plurality of moving machines are allowed to transmit the communication data, respectively, may be stipulated so as to have time lengths equal to each other.

In this way, by only stipulating the order of data transmission of each transmitter and each moving machine in a predetermined period, each transmitter and each moving machine can specify a period in which the self data can be transmitted. For example, when a time length of the transmission period of the transmitter is T1 and a time length of the transmission period of the moving machine is T2, a transmitter and a moving machine, whose transmission timing is set after the ith transmitter and the jth moving machine as counted from the transmitter whose transmission timing is set to be first, may start transmission after T1×i+T2×j from the first transmission start time.

The data transmission schedule may be stipulated such that the transmission timing of the communication data of one of the plurality of moving machines arrives next after the transmission timing of the operation data of one of the plurality of transmitters which corresponds to said one of the plurality of moving machines.

In this way, merely by starting transmission of the self transmission data immediately after receiving operation data from the transmitter corresponding to oneself, the moving machine can carry out the transmission without overlapping on the transmission timings of the transmitter and the other moving machines.

When said one of the plurality of moving machines receives the communication data transmitted from another one of the plurality of moving machines, said one of the plurality of moving machines may specify said another one of the plurality of moving machines on the basis of the identification information contained in the operation data received immediately before receipt of the communication data transmitted from said another one of the plurality of transmitters.

In this case, even if identification information is not added to the transmission data, it can be judged from which of the moving machines the transmission data is transmitted. Therefore, information which can be added to one block of communication data can be reduced, or the transmission/receiving time data can be shortened by reducing one block of communication. Also, when the transmission timing of the moving machine next corresponding to the transmitter is set, only the identification information contained in the operation data received immediately before is held, and it may merely be referred to, and the burden on the hardware can be reduced.

When each of the plurality of moving machines receives the operation data transmitted from each of the plurality of transmitters or the communication data transmitted from each of the plurality of moving machines, each of the plurality of moving machines judges whether the received data is either of the operation data or the communication data by comparing a receiving timing of the received data and the transmission timing of each of the plurality of transmitters and each of the plurality of moving machines stipulated by the data transmission schedule.

In this case, there is no need to add to the data information for judging whether it is either of operation data or communication data, and information which can be added to one block of data can be reduced, or the transmission/receiving time can be shortened by reducing one block of data.

According to the present invention, there is provided a moving machine which is combined with a transmitter capable of transmitting operation data including identification information for identifying oneself, operation control information for controlling an operation of one of objects of control, and communication control information for controlling communication between said objects of control, and which is used as said one of the objects of control, the moving machine comprising: a communication data preparing device which prepares communication data making another moving machine execute a predetermined processing; a communication data transmitting device which transmits the communication data; a data receiving device which receives the operation data transmitted from the transmitter and the communication data transmitted from said another moving machine; and a moving machine controlling device which, when the operation data containing the identification information unique to the transmitter corresponding to oneself is received, controls self operation on the basis of the operation control information contained in the operation data, and controls preparation and transmission of the communication data on the basis of the communication control information contained in the operation data, and which, when the communication data from said another moving machine is received, executes a predetermined processing corresponding to the received communication data, wherein the moving machine controlling device refers to a receiving timing of the operation data transmitted from the transmitter to be combined with oneself or another transmitter, and specifies a self transmission timing which is stipulated, by a predetermined data transmission schedule shared by the transmitter to be combined with oneself, said another transmitter and said another moving machine, such that the transmission timing of the operation data from each of the transmitter to be combined with oneself and said another transmitter and the transmission timing of the communication data from said another moving machine do not overlap each other, and makes the communication data transmitting device transmit the communication data according to the specified transmission timing.

The remote control system of the present invention can be structured if, at each transmitter, devices are provided which ready a transmitter for each moving machine, set the same identification information for a moving machine and a transmitter which form a set, set a common data transmission schedule stipulated such that the transmission timings do not overlap, specify the self transmission timing stipulated by the data transmission schedule by receiving data from another transmitter, and control the transmission timing.

Note that the moving machine of the present invention may include various types of preferable modes in the above-described remote control system. Namely, the aforementioned data transmission schedule may be stipulated such that transmission timing of each of the operation data and the communication data cyclically arrives in a predetermined order. In each cycle, a period in which the moving machine is allowed to transmit the communication data may be stipulated so as to be a time length equal to a period in which said another moving machine is allowed to transmit the communication data. The aforementioned data transmission schedule may be stipulated such that the transmission timing of communication data arrives next after the transmission timing of operation data of the transmitter to be combined with oneself. When the communication data transmitted from said another moving machine is received, the moving machine specifies said another moving machine which transmitted the communication data on the basis of the identification information contained in the operation data received immediately before receipt of the communication data. When the operation data which is transmitted from each of the transmitter to be combined with oneself and said another transmitter or the communication data transmitted from said another moving machine are received, it is judged whether the received data is either the operation data or the communication data by comparing the receiving timing and the transmission timing stipulated by the data transmission schedule.

DETAILED DESCRIPTION OF THE INVENTION

Figure 1:
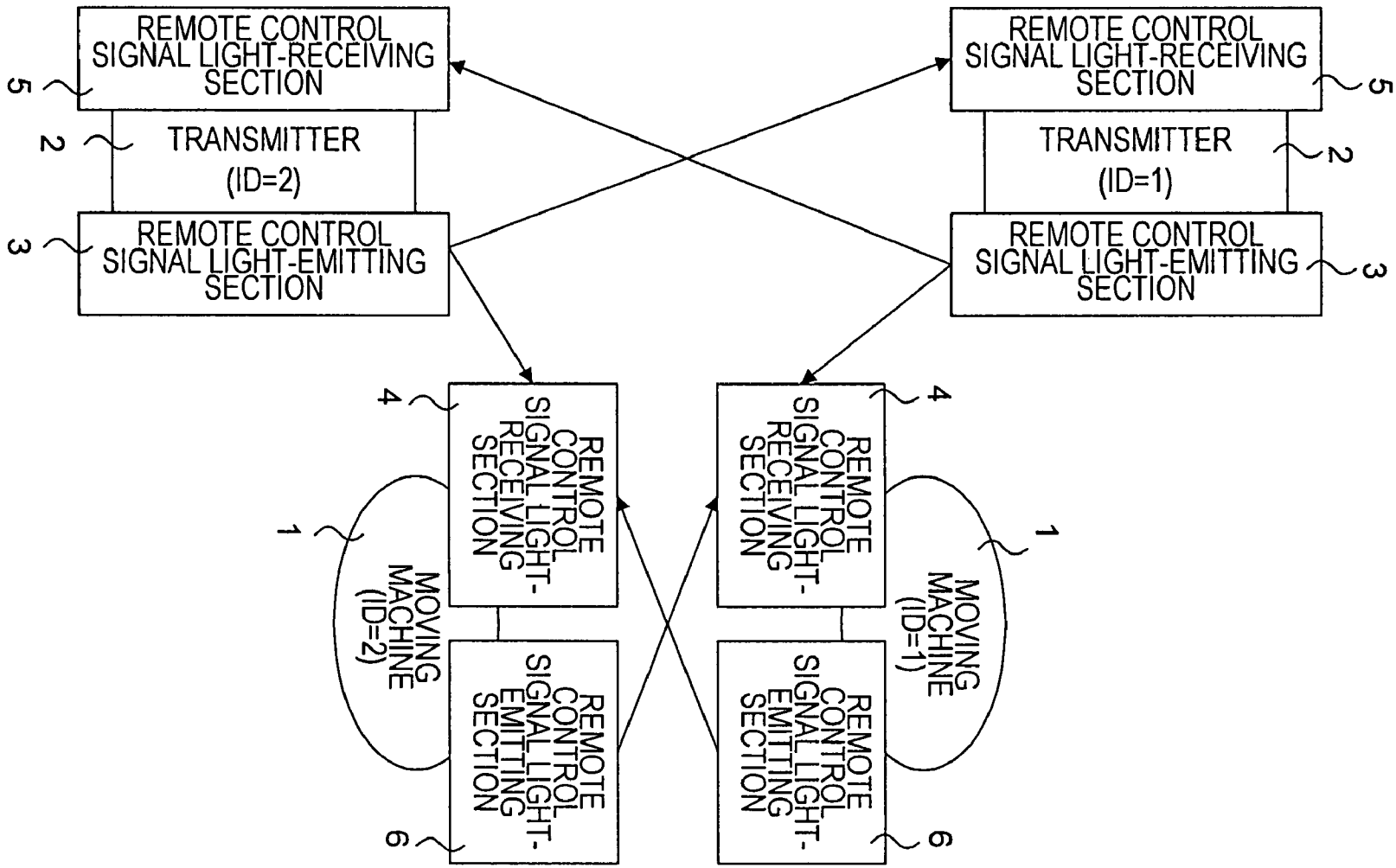
FIG. 1 is a diagram showing a schematic structure of a remote control system of the present invention.

FIG. 1 is a diagram showing a schematic structure of a remote control system of the present invention. Note that, in FIG. 1, a case in which two moving machines 1 . . . 1 are remote-controlled at a same place, and interaction based on communication between the moving machines 1 . . . 1 is caused is supposed.

Transmitters 2 . . . 2 are readied in a one-to-one correspondence with the respective moving machines 1 . . . 1. The numbers 1, 2 are set as IDs for the moving machines 1 . . . 1 and the transmitters 2 . . . 2, respectively. Each moving machine 1 is remote-controlled on the basis of data from the transmitter 2 to which the same ID is given. Infrared radiation is utilized for remote-control of each moving machine 1. Therefore, a remote control signal light-emitting section 3 is mounted to each transmitter 2, and a remote control signal light-receiving section 4 is mounted to each moving machine 1. Moreover, in order to synchronize data the transmission from each transmitter 2, a remote control signal light-receiving section 5 is mounted to each transmitter 2. Further, infrared radiation is utilized for communication between the moving machines 1 . . . 1 as well. Therefore, a remote control signal light-emitting section 6 is mounted to each moving machine 1 in order to carry out communication with the other moving machine and the aforementioned remote control signal light-receiving section 4 of the moving machine 1 also receives signals from the remote control signal light-emitting section 6 of the other moving machine 1.

Hereinafter, as an embodiment of the remote control system of the present invention, a toy remote-controlling a miniature tank model 30 shown in FIGS. 3A and 3B by the transmitter 10 shown in FIG. 2 will be described. A user controls the travelling of the tank model 30 and the turning operation of a turret section 32, and fires at the tank model 30 remote-controlled by another user. Firing is realized by communication utilizing infrared radiation radiated at relatively narrow angles A, B from a barrel 42. When the tank model 30 receives communication by infrared radiation from another tank model 30, namely, when the tank model 30 is hit, a predetermined processing for notifying the user of the hit of the tank model 30, in which, for example, remote control is made impossible for a constant time or an LED is lighted, or a predetermined processing as a penalty in the game, is executed at the tank model 30 which has been hit. This processing can be executed as a different processing according to which tank model 30 the fire has come from.

Figure 2A:
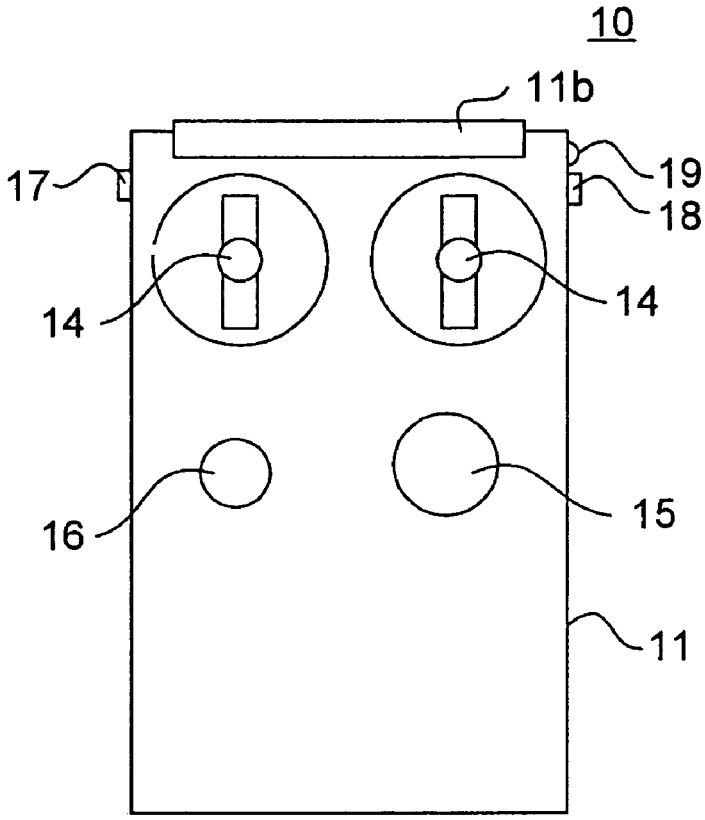
FIGS. 2A and 2B are a top view and a diagram viewed from a front surface side of a transmitter for a tank model as an embodiment of a transmitter.
Figure 2B:
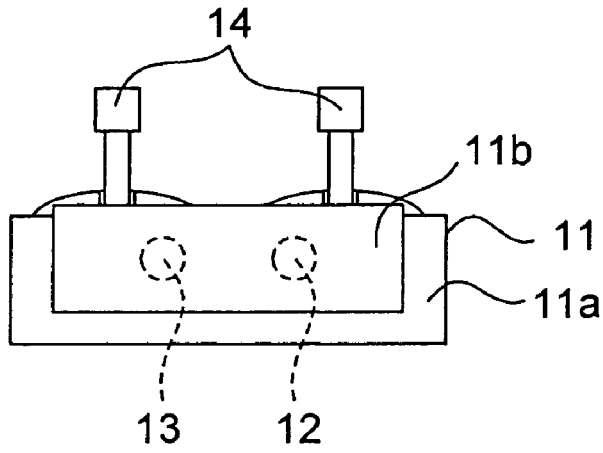
Figure 3:
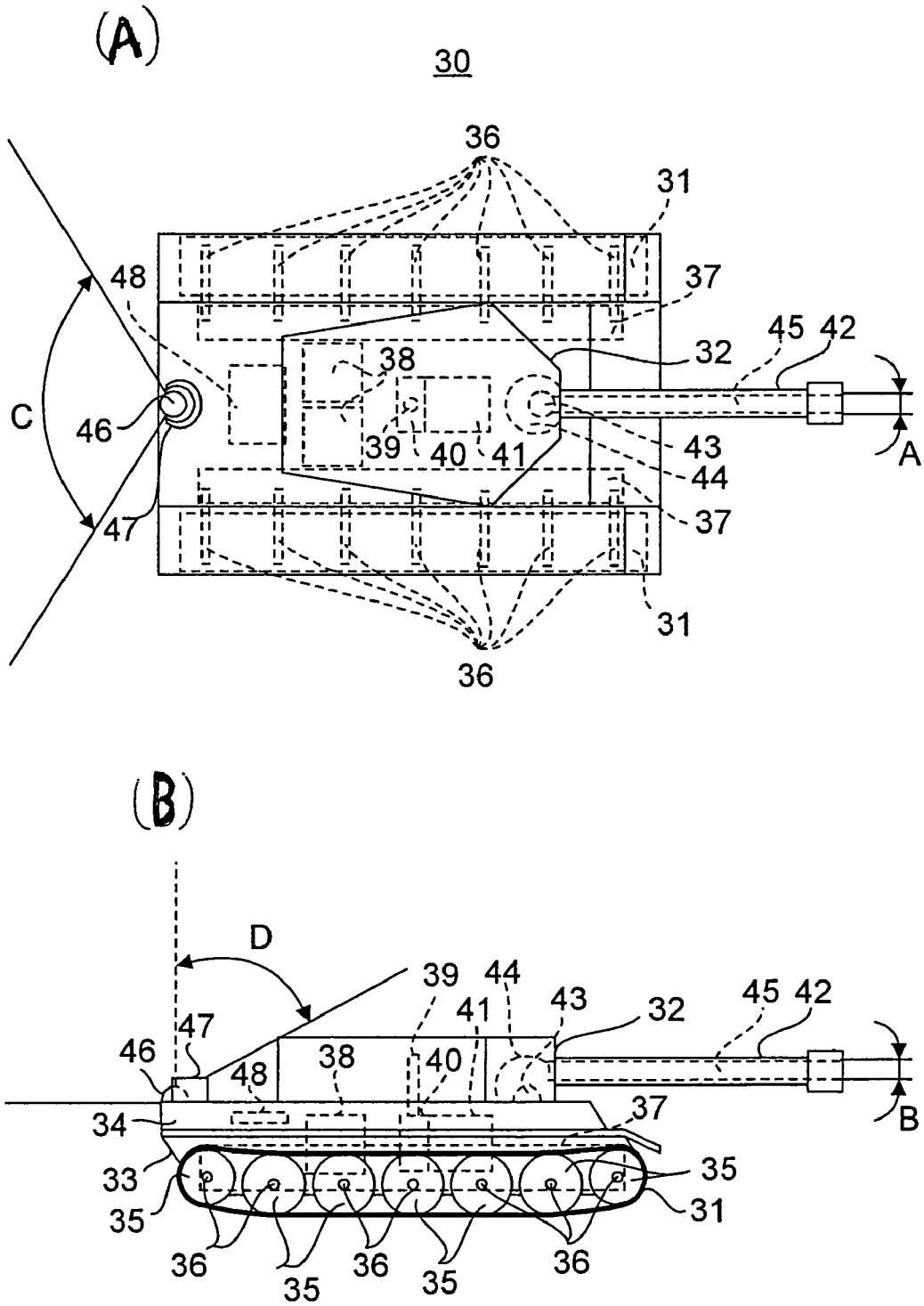
FIGS. 3A and 3B are a plan view and a side view of a tank model as an embodiment of a moving machine.

FIGS. 2A and 2B show the transmitter 10 remote controlling the tank model 30, FIG. 2A is a top view and FIG. 2B is a view from the front surface side. As shown in these views, the transmitter 10 has a housing body 11 structured from resin or the like. A cover 11*b* through which infrared radiation passes is provided at a front surface 11*a* of the housing body 11, and a light-emitting section 12 (corresponding to the remote control signal light-emitting section 3 of FIG. 1) for transmitting data to the tank model 30 and a light-receiving section 13 (corresponding to the remote control signal light-receiving section 5 of FIG. 1) for receiving data from other transmitters 10 are provided at the inner side thereof. Further, a set of right and left travelling control levers 14 . . . 14 to be operated for respectively individually controlling the travelling direction and speed of a set of right and left caterpillars 31 . . . 31 (refer to FIG. 3) provided at the tank model 30, a turret section control dial 15 to be operated for making the turret section 32 of the tank model 30 turn, a firing key 16 for instructing firing at the tank model 30, and an ID setting switch 17 for setting the ID of the transmitter 10 are provided at the housing body 11. Each travelling control lever 14 can switch between forward travelling and reverse travelling of the corresponding caterpillar 31 by being downwardly pivoted forward and backward from a neutral position corresponding to speed 0, and outputs a speed instruction signal proportional to the amount of downward pivoting. The turret section control dial 15 outputs a turning instruction signal corresponding to a direction of rotation and an amount of rotation when a rotating operation is carried out. The firing key 16 is a push-button switch, and outputs a firing instruction signal when a pushing operation is carried out. The ID setting switch 17 is capable of being operated to switch between four positions corresponding to IDs of 1 through 4, and outputs signals corresponding to these positions. The ID of the transmitter 10 can be selected from among 1-4 by switch-operating the ID setting switch 17. Note that, in addition to these, a power source switch 18 switching the ON/OFF of a power source, and an LED 19 showing the operating condition of the transmitter 10, are also provided at the transmitter 10.

FIG. 3A is a plan view of the tank model 30, and FIG. 3B is a side view. The tank model 30 has a chassis 33 and a body 34 covered on the top portion of the chassis 33. Wheels 35 . . . 35 are provided so as to form rows on the left and the right of the chassis 33, and the caterpillars 31 are stretched over one on each row of the wheels 35 (one at each of the left and the right). At least one among the wheels 35 of each row is mounted to a travelling transmission device 37 via axles 36 . . . 36, and the other wheels are freely-rotatably mounted to the chassis 33 via the axles 36 . . . 36. The travelling transmission device 37 transmits the rotation of a motor 38 for travelling, which serves as a driving source, to the axles 36 . . . 36. The travelling transmission devices 37 and the motors 38 for travelling are provided one at each of the left and the right in correspondence with the set of left and right caterpillars 31 . . . 31, and the left and right caterpillars 31 can be individually driven. The turret 32 is provided at the upper portion of the body 34, so as to be able to turn around a shaft 39. The turret 32 and the shaft 39 can rotate integrally, and the lower end portion of the shaft 39 is mounted to a turret section transmission device 40. The turret section transmission device 40 transmits rotation of a turret motor 41 as a driving source to the shaft 39.

The barrel 42 is provided at the turret section 32. A light-emitting section 43 (corresponding to the remote control signal light-emitting section 6 of FIG. 1) for transmitting data to another tank model 30 is provided at the front portion of the turret section 32 to which the barrel 42 is mounted. The infrared radiation transmitted from the light-emitting section 43 is led by a condensing body 44 to an optical fiber 45 provided at the barrel 42. The infrared radiation carried by the optical fiber 45 is emitted at predetermined emission angles A, B, from the front of the barrel 42 in a direction which the barrel 42 faces. Note that, in the present embodiment, because a situation in which the transmitter 10 is operated above the tank model 10 is supposed, if the transmission data is emitted from the barrel 42 in narrow angles A, B, there is no radio interference due to the transmitter 10 receiving the emitted transmission data.

Alight-receiving section 46 (corresponding to the remote control signal light-receiving section 4 of FIG. 1) for receiving signals from the transmitter 10 and the other tank model 30 is provided at a rear portion of the body 34. When the light-receiving section 46 receives data transmitted from the light-emitting section 43 of the other tank model 30, it is considered that the tank model 30 has been hit, and a processing for notifying user that tank model has been hit or a predetermined processing as a penalty in the game is executed. At the front side of the light-receiving section 46, a cover 47 shielding infrared radiation is provided so as to receive the signal from the other tank model 30 only from a rearward predetermined angle C. In accordance therewith, a game method in which it is judged to be hit only when hit from behind by the other tank model 30 can be realized. Note that the height of the cover 47 is limited such that the light-receiving section 46 can also receive a signal from ahead if the signal is in a range from directly above to an angle D. Accordingly, the cover 47 does not hinder remote control from the transmitter 10 provided above the tank model 30.

A control device 48, in which a microprocessor, an oscillator, a memory, a motor driver, and the like are disposed on the same substrate, is provided at the interior of the tank model 30. The control device 48 judges whether the data sent from the light-receiving section 46 is from the transmitter 10 corresponding to the self tank model 30 or is from another tank model 30. When it is judged to be data from the transmitter 10 corresponding to the self tank model 30, on the basis of the data, the control device 48 controls operations of the motors for travelling 38 . . . 38 and the turret motor 41, and transmits the data from the light-emitting section 43 to another moving machine. When it is judged to be data from another tank model 30, the control device 48 executes a predetermined processing for the time of being hit.

Figure 4:
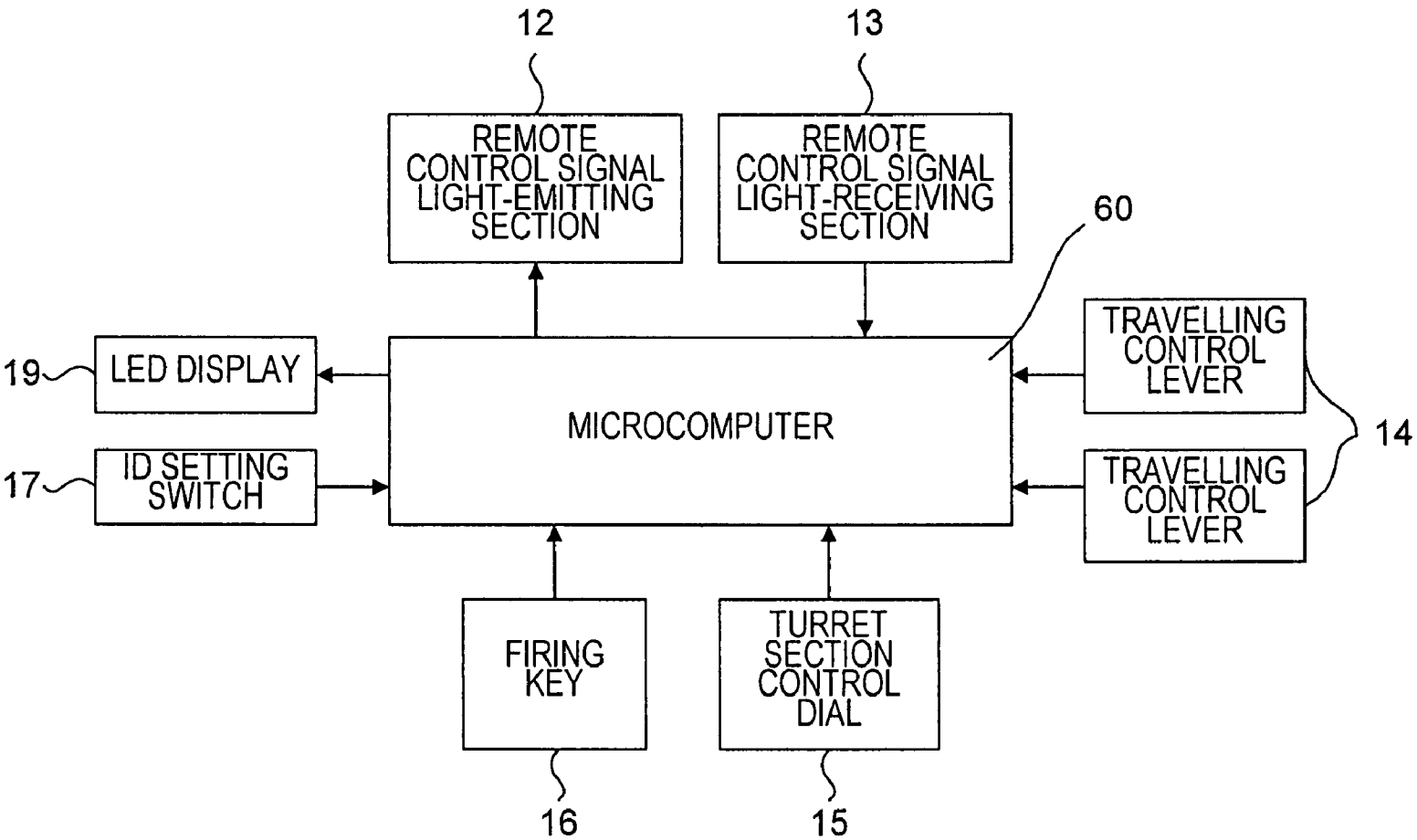
FIG. 4 is a diagram showing a circuit structure of the transmitter of FIGS. 2A and 2B.

FIG. 4 shows the circuit structure of the transmitter 10. Signals corresponding to operations of the travelling control levers 14 . . . 14, the turret section control dial 15, the firing key 16, and the ID setting switch 17 are inputted to a microcomputer 60. The remote control signal light-emitting section 12 is structured so as to include a light-emitting device such as, for example, an LED or the like, and emits infrared radiation according to remote control data generated by the microcomputer 60. Note that remote control data of 1 block generated by the microcomputer 60 will be described later (refer to the explanation of FIG. 6).

On the other hand, the remote control signal light-receiving section 13 shown in FIG. 4 receives infrared radiation transmitted from another transmitter 10, and outputs a signal, in which the carrier component is removed from the received infrared radiation, to the microcomputer 60. The microcomputer 60 controls the transmission timing of the self data on the basis of the received data. In this way, setting the transmission timing after receiving the transmitted data of another transmitter 10 is for preventing radio interference due to simultaneous transmission of remote control data from a plurality of the transmitters 10 and a plurality of the tank models 30.

Note that, a dry cell as a power source, a power source circuit converting the electric current/voltage of the dry cell to a predetermined electric current/voltage, an oscillator providing a clock signal to the microcomputer 60, a charging circuit or a charging terminal charging a secondary cell as the power source of the tank model 30, and the like are provided (not shown) at the transmitter 10 in addition to the power source switch 18 shown in FIG. 2A and the LED 19 showing that the transmitter 10 is in an operating state both.

Figure 5:
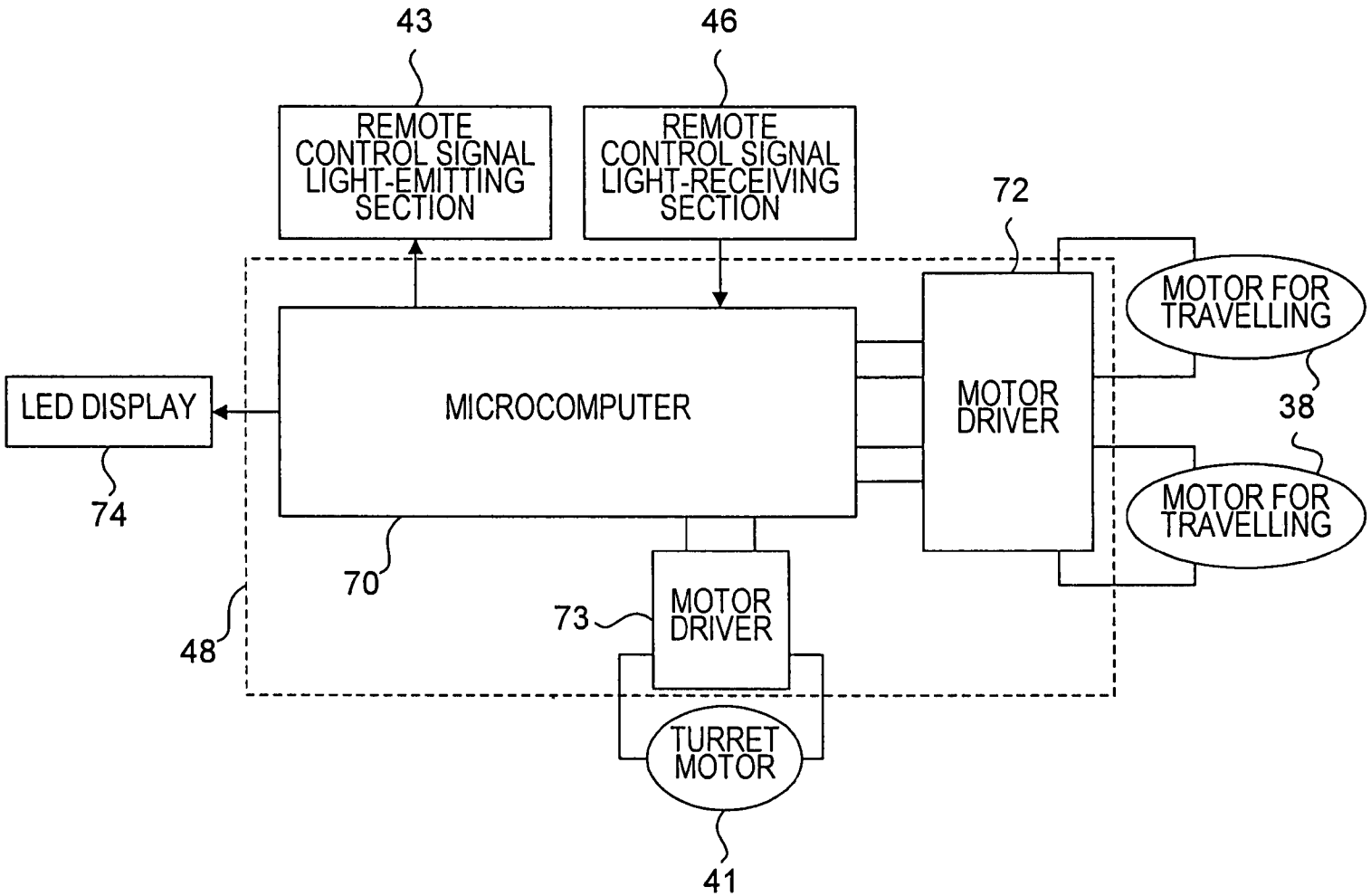
FIG. 5 is a diagram showing a circuit structure of the tank model of FIGS. 3A and 3B.

FIG. 5 shows the circuit structure of a control system mounted at the tank model 30. The remote control signal light-receiving section 46 for receiving signals from the transmitter 10 and the other tank model 30 is provided at the tank model 30. The remote control signal light-receiving section 46 outputs a signal, in which the carrier component is removed from the received infrared radiation, to a microcomputer 70. The microcomputer 70 decodes the signal provided from the remote control signal light-receiving section 46 into remote control data of one block.

When the signal from the transmitter 10 corresponding to the self tank model 30 is received, on the basis of the received data, the microcomputer 70 provides an instruction to drive the motors for travelling 38 . . . 38 to a motor driver 72, and an instruction to drive the turret motor 41 to a motor driver 73. Moreover, if there is an instruction to fire in the received data, the microcomputer 70 generates data to be transmitted to the other tank model 30, and provides an instruction to transmit the data to the remote control signal light-emitting section 43 at a transmission timing based on the time when the data is received from the transmitter 10. Here, transmitting the data at a transmission timing based on the time when the data is received from the transmitter 10 is for preventing radio interference due to simultaneous transmission of remote control data from a plurality of the transmitters 10 and a plurality of the tank models 30. The remote control signal light-emitting section 43 is structured so as to include a light-emitting device such as, for example, an LED or the like.

When a signal from the other tank model 30 is received, on the basis of the received data, the microcomputer 70 makes remote control operation impossible for a constant time, or executes a processing for the time of being hit, such as lighting an LED or the like.

A secondary cell as a power source, a power switch switching the ON/OFF of the power source, a power source circuit converting the electric current/voltage of the secondary cell to a predetermined electric current/voltage, an oscillator providing a clock signal to the microcomputer 70, a nonvolatile memory for holding the ID allocated to the self tank model 30, and the like are provided (not shown) at the tank model 30 in addition to an LED 74 showing that the tank model 30 is in an operating state.

Figure 6:
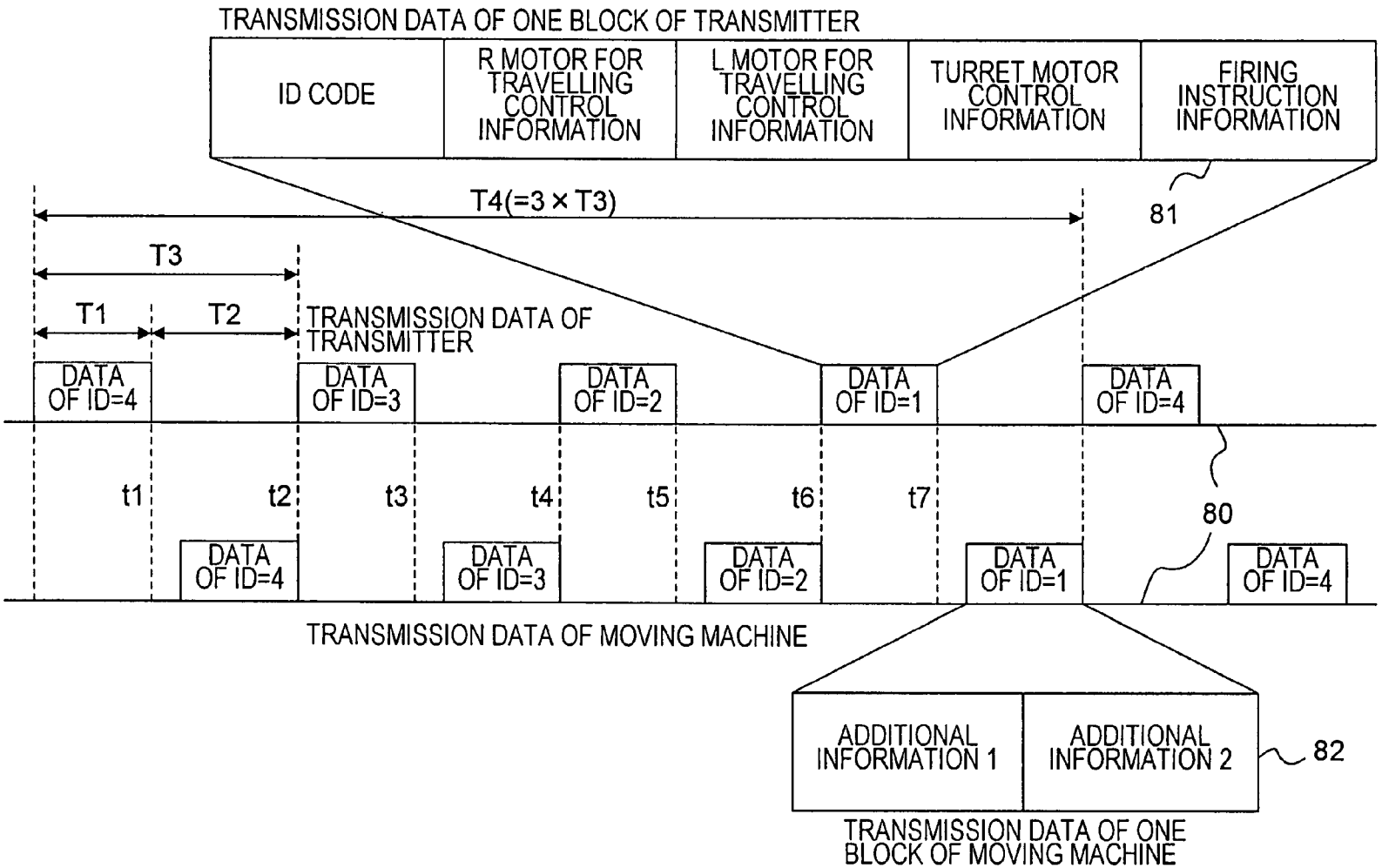
FIG. 6 is a diagram showing a data transmission schedule stipulated such that data transmission timings of the transmitter of FIGS. 2A and 2B and the tank model of FIGS. 3A and 3B do not overlap one another.

FIG. 6 shows data transmission schedule stipulated such that the data transmission timings of the respective transmitters 10 and the tank models 30 do not overlap on each other. A time axis 80 at the upper stage shows the data transmission schedule of the transmitters 10. Between a transmission time (time length T1) and a transmission time (time length T1) of each transmitter 10, an interval of time length T2, in which none of the transmitters 10 transmits, is provided. The time axis 80 at the lower stage shows the data transmission schedule of the tank models 30, and a transmission time of each tank model 30 is disposed between the transmission time and the transmission time of each transmitter 10. Further, transmission data 81 shows the contents of one block of remote control data generated by the transmitter 10, and transmission data 82 shows the contents of one block of remote control data generated by the tank model 30. Hereinafter, the contents of the transmission data and the data transmission schedule in the present embodiment will be described with reference to the Figure.

The one block of remote control data generated by the microcomputer 60 of the transmitter 10 is structured from an ID code, control information of the left and right motors for travelling, control information for the turret, and firing instruction information. Data corresponding to an ID selected by the ID switch 17, for example, data of 2 bits, is set at the ID code portion. At each of the control information portions of the left and right motors for travelling, data of 1 bit designating the driving direction and data of 3 bits designating the speed are set in correspondence with operated positions of the travelling control levers 14. At the control information for the turret motor, data of 1 bit instructing whether to turn or not and data of 1 bit for designating a direction of rotation are set in correspondence with the operation of the turret section control dial 15. At the firing instruction information, data of 1 bit designating whether to fire or not is set in correspondence with operation of the firing key 16. Note that the number of bits of one block of remote control data is always constant. Accordingly, the time needed for transmitting one block of remote control data is constant.

One block of remote control data generated in the microcomputer 70 of the tank model 30 is structured from additional information making the other tank model 30 execute a predetermined processing. In the present embodiment, the additional information is not necessarily needed. However, various changes can be applied by the additional information to the predetermined processing which the hit tank model 30 executes. Note that the number of bits of one block of remote control data is always constant. Accordingly, the time needed for transmitting one block of remote control data is constant.

When four sets of the transmitters 10 for which ID=1-4 are set and the tank models 30 which are objects of control thereof are used at the same time, the transmission timing of each set is set at a period different from those of the other sets, and further, the transmission timings of the respective transmitters 10 and tank models 30 are set to periods different from each other. The length of time in which one set of the transmitter 10 and the tank model 30 transmits remote control signals is T3, and each transmitter 10 and each tank model 30 repeats transmission of remote control signals at a period T4 (=4×T3) corresponding to the number of sets×transmission time length T3. Further, the transmission timing of each set is shifted in order by T3 from ID=4. Moreover, the transmission time length T3 of each set is structured from a transmission time length T1 of the transmitter 10 and a time length T2 which follows T1 and in which transmission of the tank model 30 is allowed. Due to each transmitter 10 and each tank model 30 managing the transmission timing according to such a relationship, it is possible for the transmission periods from the four transmitters 10 and the four tank models 30 to not overlap on each other.

In order to realize such transmission control, for example, if there are the transmitter 10 and the tank model 30 of ID=3 of FIG. 6, it suffices that the transmission timing is controlled as follows. First, with regard to the transmitter 10 (ID=3), when the transmission data of the transmitter 10 of ID=4 is received at time t1, a transmission timer is set to T2 later, and timer counting starts. This time T2 is a time in which the tank model 30 of ID=4 is allowed to transmit data. At a time t2 at which the counting of the transmission timer has passed by time T2, the transmitter 10 (ID=3) starts to transmit self data, and completes transmission at time t3 after T1 from the state of transmission. At the time of completing transmission, the received data is checked, and it is confirmed that radio interference of the signals has not arisen. Thereafter, the transmission timer counting the next transmission timing is set to T2+3×T3 later, and timer counting is started. If there is an instruction to fire in the received data, the tank model 30 (ID=3), which received the transmission data of the transmitter 10 (ID=3) at time t3 carries out transmission of data from the completion of receiving to the time T2 in which the self transmission is allowed. When the transmitter 10 (ID=3) which has counted the transmission timing from time t3, receives the transmission data of the transmitter 10 of ID=2 at time t5, the transmitter 10 resets the transmission timer to T2+2×T3 later, and starts timer counting. When the transmitter 10 (ID=3) receives the transmission data of the transmitter 10 of ID=1 at time t7, the transmitter 10 resets the transmission timer to T2+T3 later, and starts timer counting. Thereafter, when the power source of the transmitter 10 of ID=4 is turned off, or when the data from the transmitter 10 of ID=4 cannot be received due to noise or the like, after receiving the data of ID=1, it suffices that output of self data is started at the point in time when the counting of the transmission timer has passed time T2+T3. Moreover, even when the signal from another transmitter 10 cannot be received, transmission of data can be continued at period T4 (=4×T3) by utilizing the time T2+3×T3 set at the transmission timer at the time of completion of transmission of self data. Further, due to the transmitter 10 being able to continue transmission of data at period T4, the tank model 30, which sets the transmission timing on the basis of the time when data from the transmitter 10 is received, can continue transmission of data at period T4.

Note that, here, a case in which there are four sets of the transmitters 10 and the tank models 30 was described. However, by adding IDs, the transmission timing can be controlled in the same way even in a case in which there are five or more sets. The period of the transmission timing of each transmitter 10 and each tank model 30 is N×T3 (N is the number of sets). However, a blank period in which data is not transmitted is respectively set between periods in which each transmitter 10 and each tank model 30 are transmitting data, and in accordance therewith, the entire period may be set to be longer than N×T3.

Figure 7:
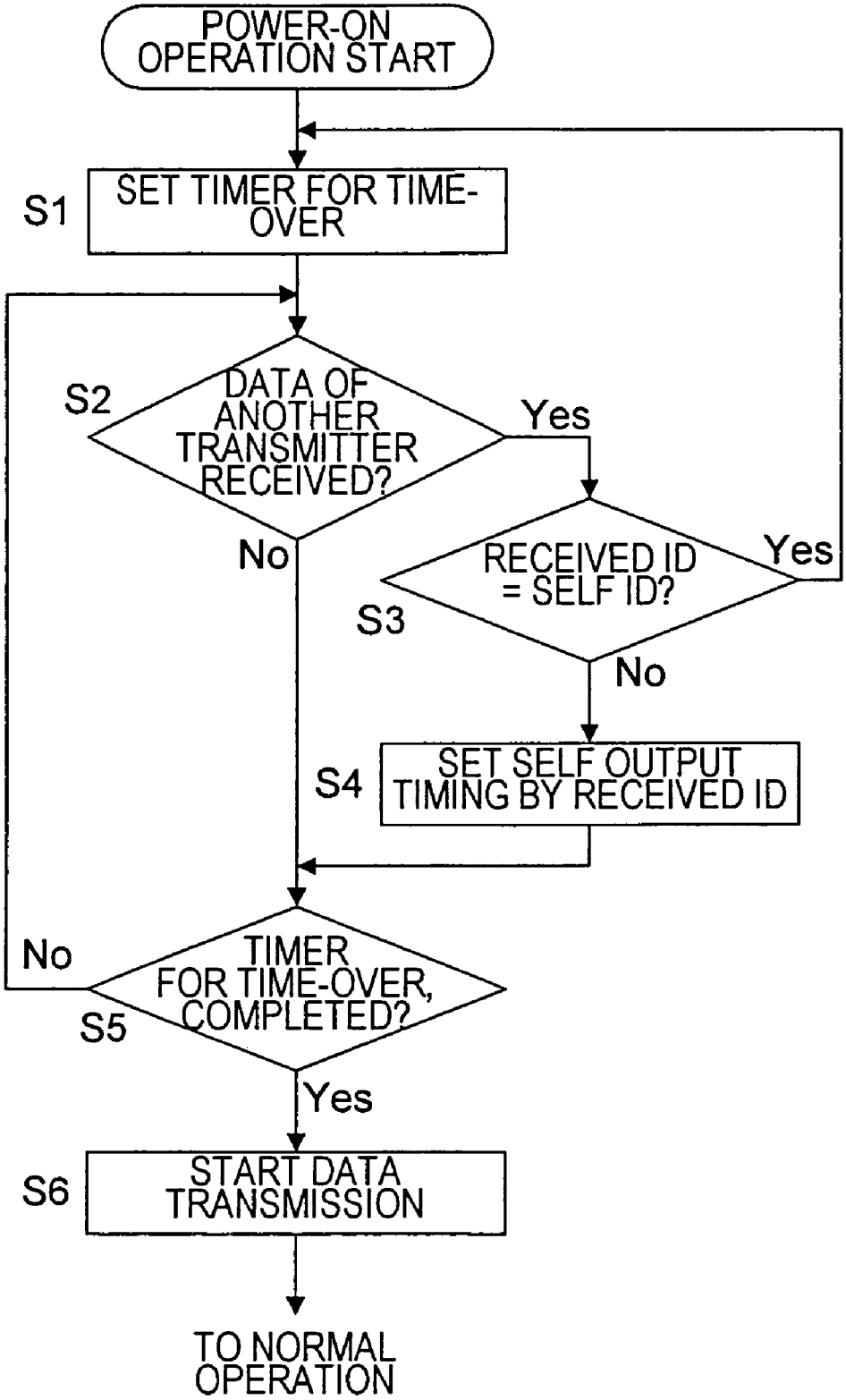
FIG. 7 is a flowchart showing procedures of power-on operation which a microcomputer of the transmitter of FIGS. 2A and 2B executes from turning-on of a power source until starting of transmission of self data.

FIG. 7 is a flowchart showing procedures of power-on operation executed by the microcomputer 60 of the transmitter 10 from turning on of the power until start of transmission of self data. When the power is turned on, first, a timer for time-over is set (step 1). Next, it is judged whether data from another transmitter 10 has been received or not (step S2), and when data has been received, it is judged whether or not the ID of the received data is the same as the ID set for the self transmitter 10 (step S3). If the IDs match, the routine returns to step S1, and judging operations are repeated. In accordance therewith, radio interference in a case in which there are plural transmitters 10 having the same ID is prevented. In step S3, when it is judged that the IDs do not match, the self transmission timing is set according to the ID of another transmitter 10 (step S4). For example, when the transmitter 10 of ID=3 of FIG. 6 receives data of ID=2, the self transmission timing is set to T2+2×T3 later.

Next, it is judged whether the timer set at step S1 is time-over or not (step S5). If the timer is not time-over, the routine returns to step S2. When the time is over, transmission of data remote-controlling the self tank model 30 is started (step S6). However, the actual time of starting output is the time at which the transmission timing set at step S4 has been reached. If no data has been received up until time over, there is single operation, i.e., there is no other transmitter 10. Therefore, transmission of data is immediately started at step S6.

Figure 8:
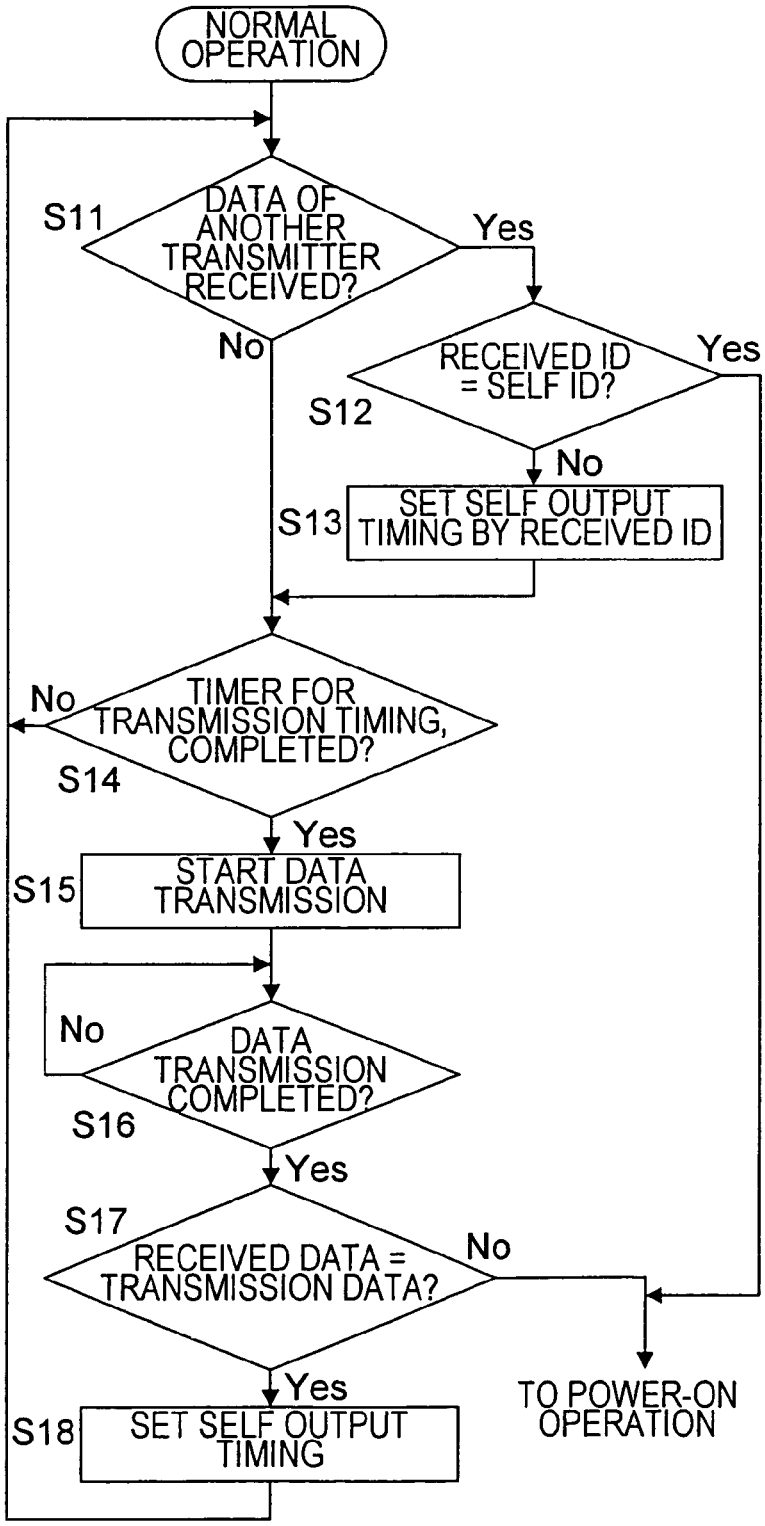
FIG. 8 is a flowchart showing procedures of normal operations which the microcomputer of the transmitter of FIGS. 2A and 2B executes after the processing of FIG. 7.

When the processing of step S6 is completed, the microcomputer 60 controls data transmission according to the procedures of normal operation of FIG. 8. In normal operation, first, it is judged whether the data from another transmitter 10 has been received or not (step S11), and if data has been received, it is judged whether the ID thereof matches the ID set for oneself or not (step S12). If the IDs match, the routine returns to the power-on operation of FIG. 7. On the other hand, when the ID of the received data is different from the self ID, the self transmission timing is set at the transmission timer according to the ID of the received data (step S13). Next, it is judged whether the transmission timer is time-up or not (step S14), and the routine returns to step S11 until time is up.

When it is judged that time is up at step S14, transmission of the self data is started (step S15). At this time, receipt of data is carried out in parallel. Next, it is judged whether the data transmission is completed or not (step S16), and if the transmission is completed, the transmitted data and the data received in parallel with the transmission are compared (step S17). If the transmitted data and the received data do not coincide, it is judged that radio interference has arisen, and the routine proceeds to the power-on operation of FIG. 7. If the transmitted data and the received data coincide, because it may be considered that there is no radio interference, the next transmission timing is set at the transmission timer (step S18). Thereafter, the routine returns to step S1.

Figure 9:
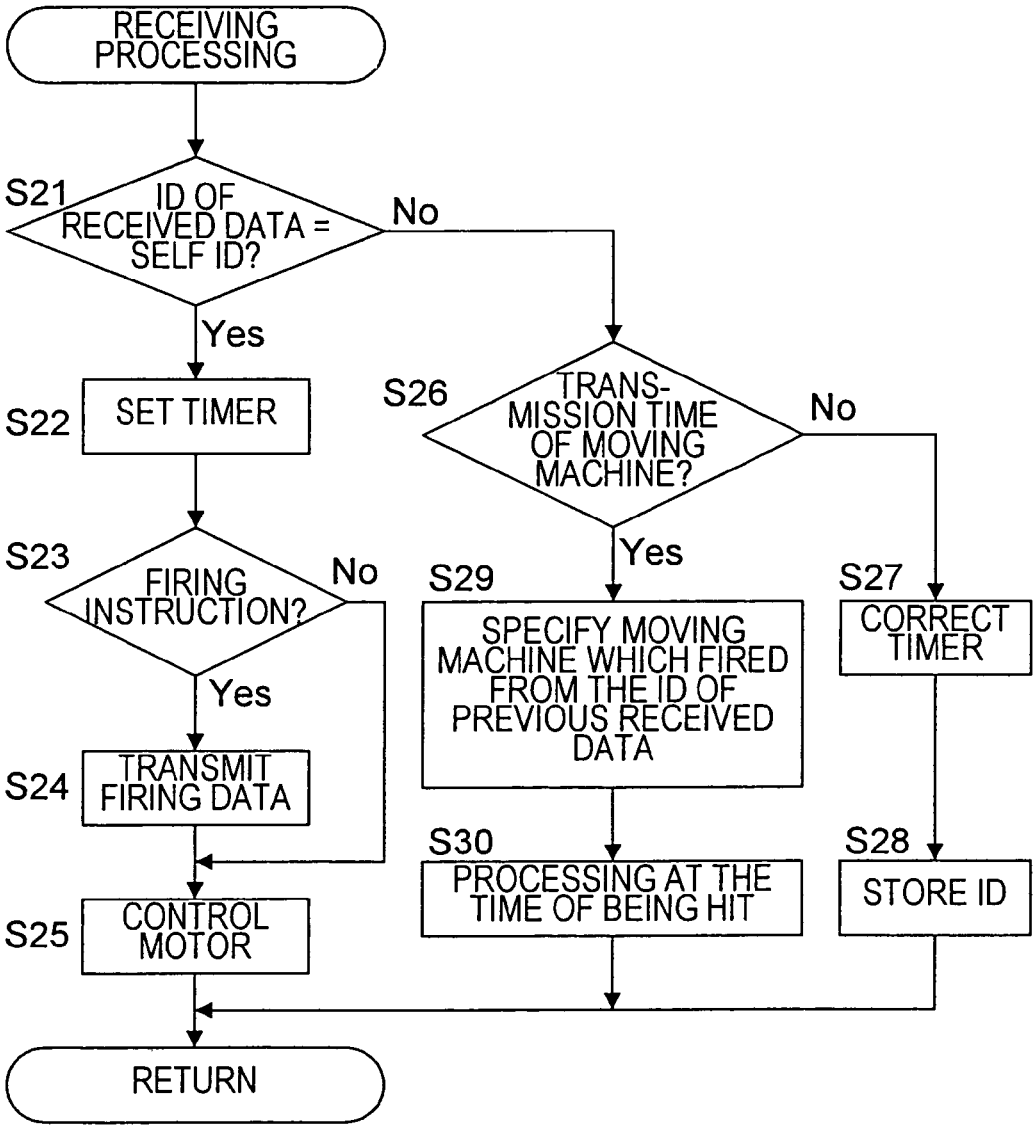
FIG. 9 is a flowchart showing processing procedures when a microcomputer of the tank model of FIGS. 3A and 3B receives data.

FIG. 9 is a flowchart showing receiving processing procedures which the microcomputer 70 of the tank model 30 executes when receiving data from the remote control signal light-receiving section 46. First, the microcomputer 70 judges whether an ID contained in the received data coincides with an ID allocated to the self tank model 30 (step S21). If the IDs match, namely, when it is judged that the received data is the data transmitted from the transmitter 10 corresponding to the self tank model 30, the timer is set so as to be able to refer to the data transmission schedule of FIG. 6 in which the time axis is corrected on the basis of the time when the data was received (step S22).

The transmission timing of the self tank model 30 can be adjusted by the timer, and whether the received data is data from the transmitter 10 or from another tank model 30 can be specified from the time when the data was received. The setting of the timer and the referring to the data transmission schedule may be carried out, for example, as follows. First, when remote control data having the same ID as the ID allocated to the self tank model 30 (i.e., transmission data from the transmitter 10 corresponding to the self) is received, at the time of completion of receiving, the time T2 is set at the timer and a flag expressing that it is the transmission time of the tank model 30 is set. Thereafter, operation in which, at the point in time when the timer-count has passed by time T2, T1 is reset and the flag is reset, and at the point in time when the timer-count has passed by time T1, time T2 is reset and the flag is set, is repeated. In accordance therewith, whether the time of receiving the data is the transmission time of the transmitter 10 or the transmission time of the tank model 30 can be distinguished. Moreover, if a counter variable is prepared, the counter variable is initialized in the transmission time of the self tank model 30. Thereafter, by increasing the counter variable each time the flag, which expresses that it is the transmission time of the tank model 30, is set, even when the transmission data from the transmitter 10 corresponding to oneself is cut-off, the self transmission timing can be known, and the ID of the received remote control data can be specified.

After the timer is set at step S22, it is judged whether there is a firing instruction or not in the firing instruction information contained in the received data (step S23). When there is a firing instruction, data transmitted to another tank model 30 is generated, and the data is transmitted at a predetermined timing (step S24). Thereafter, on the basis of the left and right motor for travelling control information and the turret motor control information contained the received data, motor-control is carried out (step S25), and the routine waits for the next receipt.

At step S21, if the ID contained in the received data does not match the ID allocated to the self tank model 30, the receiving time and the data transmission schedule set at step S22 are compared, and it is judged whether the receiving time is the transmitting time of another tank model 30 or not (step S26). When it is judged that the receiving time is not the transmission time of the tank model 30 (namely, that it is the transmission data from the transmitter 10 corresponding to another tank model 30), T2 is reset at the timer for referring to the data transmission schedule, and thereafter, due to the counting and setting of T2 and T1 being repeated, the data transmission schedule is corrected (step S27). Next, the ID contained in the received data is set to a variable for storing the ID of the received data (step S28).

At step S26, when it is judged to be the transmission time of another tank model 30, the ID substituted in at step S28 is referred to. In the present embodiment, as shown in FIG. 6, after the transmission time of the transmitter 10, the transmission time of the corresponding tank model 30 follows. Therefore, the ID of the tank model 30 which fired can be specified by the referred-to ID (step S29). Next, on the basis of the ID of the tank model 30 which fired, processing at the time of being hit, such as making remote control impossible for a constant time, lighting an LED, or the like, is executed (step S29). Note that judgement as to whether it is data transmitted from another tank model 30 or not at step S26 may be executed by 1 bit of information, for distinguishing whether it is data from the transmitter 10 or data from the tank model 30, being added to each transmission data of the transmitter 10 and the tank model 30, and the microcomputer 70 referring to the information contained the received data. Specification of data transmitted from which tank model 30 may be carried out by adding to the transmission data the ID allocated to the transmitting tank model 30, and the microcomputer 70 referring to the ID contained in the received data.

The present invention is not limited to the above-described embodiment, and may be implemented in various forms. For example, the moving machine is not limited to a tank, and may be a machine imitating various moving bodies. Interaction based on communication between the moving machines is not limited to firing, and may be conversation or the like. The light-receiving section of the moving machines is not limited to one, and a plurality of light-receiving sections may be provided. One part of the plurality of light-receiving sections may be used for receiving transmission data from a transmitter, and the other light-receiving sections may be used for receiving transmission data from another moving machine. The transmitter may be hand-holdable by an operator, or may be a type which is placed on a floor. A specific program may be installed into a portable machine such as a portable game machine or a portable telephone, and it may be made to function as a transmitter.

As described above, according to a remote control system of the present invention, each transmitter, by receiving data transmitted from another transmitter, or each moving machine, by referring to receiving timing of data transmitted from each transmitter, can transmit self data according to a data transmission schedule stipulated such that transmission timings of each transmitter and each moving machine do not overlap. Accordingly, the data from each transmitter and the data from each moving machine can be transmitted on the same carrier signal, and, at each moving machine, the sharing of a receiving device and a processing system of signals from the transmitter and signals from over moving machines can be advanced. In accordance therewith, without leading to complexity of a structure of the moving machine and an increase of electric power consumption, a plurality of moving machines can be remote-controlled and interaction based on communication can be brought about among the moving machines.

The invention claimed is:

1. A remote control system comprising:

a plurality of transmitters;

a plurality of moving machines, which are configured to correspond respectively to the plurality of transmitters, said moving machines being individually controlled by the plurality of transmitters, and said system causing interactions between the moving machines based on communication between the moving machines, wherein a transmitter from the plurality of transmitters comprises:

an operation data preparing device for preparing operation data including identification information which uniquely identifies each of the plurality of transmitters, operation control information for controlling an operation of one of the plurality of moving machines, and communication control information for controlling the communication between the moving machines;

an operation data transmitting device for transmitting the operation data;

an operation data receiving device for receiving the operation data transmitted from one of the other transmitters;

a transmission timing setting device for setting a transmission timing of self operation data based on the identification information contained in the received operation data; and an operation data transmission controlling device for making the data transmitting device transmit the operation data according to the set transmission timing;

wherein a moving machine from the plurality of moving machines comprises:

a communication data preparing device for preparing communication data for making one of the other moving machines execute a predetermined process;

a communication data transmitting device for transmitting the communication data;

a data receiving device for receiving the operation data transmitted from each of the plurality of transmitters and the communication data transmitted from said one of the other moving machines; and a moving machine controlling device for controlling self-operation based on the operation control information in the operation data and for controlling preparation and transmission of the communication data based on the communication control information in the operation data after receiving the operation data from one of the transmitters, the operation data containing the identification information unique to the transmitter corresponded to oneself, and for executing the predetermined process corresponding to the communication data after receiving the communication data from said one of the other moving machines, wherein a common data transmission schedule is set for the plurality of transmitters and moving machines, the data transmission schedule stipulates that the transmission timing of each of the operation data and the communication data does not overlap, the transmission timing setting device of each of the plurality of transmitters refers to the identification information contained in the operation data from said one of other transmitters, and specifies the transmission timing of self operation data stipulated by the data transmission schedule, and the moving machine controlling device refers to a receiving timing of the operation data transmitted from at least one of the plurality of transmitters, and specifies a transmission timing of self communication data stipulated by the data transmission schedule, and makes the communication data transmitting device transmit the communication data according to the specified transmission timing.

2. The remote control system according to claim 1, wherein the data transmission schedule stipulates that the transmission timing of each of the operation data and the communication data cyclically arrives in a predetermined order.

3. The remote control system according to claim 2, wherein, in each cycle, periods in which the plurality of transmitters are allowed to transmit the operation data, respectively, are stipulated so as to have time lengths equal to each other, and periods in which the plurality of moving machines are allowed to transmit the communication data, respectively, are stipulated so as to have time lengths equal to each other.

4. The remote control system according to claim 3, wherein the data transmission schedule is stipulated such that the transmission timing of the communication data of one moving machine arrives next after the transmission timing of the operation data of one transmitters, which corresponds to said one moving machine.

5. The remote control system according to claim 4, wherein, when said one moving machine receives the communication data transmitted from one other moving machine, said one moving machine specifies said other moving machine on the basis of the identification information contained in the operation data received immediately before receipt of the communication data transmitted from one of the other transmitters.

6. The remote control system according to claim 1, wherein, when each of the plurality of moving machines receives the operation data transmitted from each of the plurality of transmitters or the communication data transmitted from each of the plurality of moving machines, each of the plurality of moving machines judges whether the received data is either the operation data or the communication data by comparing a receiving timing of the received data and the transmission timing of each of the plurality of transmitters and each of the plurality of moving machines stipulated by the data transmission schedule.

7. A moving machine which corresponds to a transmitter configured to transmit operation data including identification information for identifying oneself, operation control information for controlling an operation of one of objects of control, and communication control information for controlling communication between said objects of control, and which is used as said one of the objects of control, the moving machine comprising:

a communication data preparing device which prepares communication data that instructs another moving machine to execute a predetermined process;

a communication data transmitting device which transmits the communication data;

a data receiving device which receives the operation data transmitted from the transmitter and the communication data transmitted from another moving machine; and a moving machine controlling device which, when the operation data containing the identification information unique to the transmitter corresponding to the moving machine is received, controls an operation of itself on the basis of the operation control information contained in the operation data, and controls preparation and transmission of the communication data on the basis of the communication control information contained in the operation data, and which, when the communication data from said another moving machine is received, executes a predetermined process corresponding to the received communication data, wherein the moving machine controlling device refers to a receiving timing of the operation data transmitted from the transmitter to be combined with oneself or another transmitter, and specifies a self transmission timing which is stipulated, by a predetermined data transmission schedule shared by the transmitter to be combined with oneself, said another transmitter and said another moving machine, such that the transmission timing of the operation data from each of the transmitter to be combined with oneself and said another transmitter and the transmission timing of the communication data from said another moving machine do not overlap each other, and makes the communication data transmitting device transmit the communication data according to the specified transmission timing.

8. The moving machine according to claim 7, wherein the data transmission schedule is stipulated such that transmission timing of each of the operation data and the communication data cyclically arrives in a predetermined order.

9. The moving machine according to claim 8, wherein, in each cycle, a period in which the moving machine is allowed to transmit the communication data is stipulated so as to be a time length equal to a period in which said another moving machine is allowed to transmit the communication data.

10. The moving machine according to claim 9, wherein the data transmission schedule is stipulated such that the transmission timing of communication data arrives next after the transmission timing of operation data of the transmitter to be combined with oneself.

11. The moving machine according to claim 10, wherein, when the communication data transmitted from said another moving machine is received, the moving machine specifies said another moving machine which transmitted the communication data on the basis of the identification information contained in the operation data received immediately before receipt of the communication data.

12. The moving machine according to claim 7, wherein, when the operation data which is transmitted from each of the transmitter to be combined with oneself and said another transmitter or the communication data transmitted from said another moving machine are received, it is judged whether the received data is either the operation data or the communication data by comparing the receiving timing and the transmission timing stipulated by the data transmission schedule.

* * * * *